US006023892A

United States Patent [19]

Sourlis

[11] Patent Number: 6,023,892

[45] Date of Patent: Feb. 15, 2000

[54] COMBINATION FLASHING AND MORTAR AND DEBRIS COLLECTION DEVICE AND SYSTEM

[76] Inventor: Tom Sourlis, 3646 Ridge Rd., Highland, Ind. 46322

[21] Appl. No.: 08/729,726

[22] Filed: Oct. 7, 1996

Related U.S. Application Data

[63] Continuation-in-part of application No. 08/688,231, Jul. 29, 1996, abandoned, which is a continuation of application No. 08/567,833, Dec. 6, 1995, abandoned, which is a continuation of application No. 08/304,256, Sep. 12, 1994, abandoned, which is a continuation-in-part of application No. 08/095,053, Jul. 20, 1993, Pat. No. 5,343,661, which is a continuation of application No. 07/862,324, Apr. 2, 1992, Pat. No. 5,230,189.

[51] Int. Cl.[7] ..... E02D 19/00; E04D 17/00

[52] U.S. Cl. ..... 52/169.5; 52/169.14; 52/302.6; 210/170

[58] Field of Search ..... 210/170; 52/169.5, 52/302.4, 302.6, 169.14, 606

[56] References Cited

U.S. PATENT DOCUMENTS 4,102,093 7/1978 Harris ..... 52/101
4,986,699 1/1991 Bohnhoff ..... 210/170
5,065,557 11/1991 Laplante et al. ..... 52/235
5,115,614 5/1992 McGrath ..... 52/302.6

OTHER PUBLICATIONS

Rand et al., "Work in Progress; Crossover Technology in Brick Construction," A.I.A. Institute Scholars Program, Dec. 20, 1989, 19 pgs.

*Primary Examiner*—Jan H. Silbaugh
*Assistant Examiner*—Kenneth M. Jones
*Attorney, Agent, or Firm*—Rockey, Milnamow & Katz

[57] ABSTRACT

A combination flashing and mortar and debris collection device for use with cavity wall constructions. The device comprises a flashing member having a mortar and debris collection material applied to at least a portion of the surface thereof. The flashing member includes an upper portion that is received within the inner wall at an elevation above the floor of the cavity, an inclined central portion that extends from an elevated portion of the inner wall through the cavity to the base portion of the outer wall, and a lower portion that is received at the base of the outer wall. The lower portion of the flashing member includes means to define weep holes.

13 Claims, 1 Drawing Sheet

COMBINATION FLASHING AND MORTAR AND DEBRIS COLLECTION DEVICE AND SYSTEM

CROSS-REFERENCE TO RELATED APPLICATIONS

This application is a continuation-in-part of U.S. application Ser. No. 08/688,231, filed Jul. 29, 1996, now abandoned which is a continuation of U.S. Ser. No. 08/567,833, filed Dec. 6, 1995, now abandoned, which application is a continuation of U.S. application Ser. No. 08/304,256, filed on Sep. 12, 1994, now abandoned, which application is a continuation-in-part of U.S. application Ser. No. 08/095,053, filed on Jul. 20, 1993, now U.S. Pat. No. 5,343,661, which application is a continuation of U.S. application Ser. No. 07/862,324, filed Apr. 2, 1992, now U.S. Pat. No. 5,230,189.

FIELD OF THE INVENTION

This invention generally relates to flashings and mortar and debris collection devices, such as are used in association with cavity wall constructions. More particularly, in the course of construction of a masonry cavity wall, mortar and other debris falls into the cavity, and may then block weep holes or other water outlets necessary to prevent moisture build-up within the wall cavity. This invention more specifically relates to a device and system for directing moisture collected in the cavity and for collecting loose mortar and other debris in order to prevent the same from blocking the weep holes that ventilate such a cavity wall construction.

BACKGROUND OF THE INVENTION

The present invention found its origin in so-called masonry cavity wall constructions. Masonry cavity walls have inner and outer vertical walls. The inner wall is typically constructed from wood with an inner surface of drywall, structural clay tile, vertical stacks of mortared bricks, or a shear concrete surface. The outer wall is generally constructed from vertical stacks of bricks that are held together by mortar. A space, or cavity, exists between the two walls, which may be partially filled with insulation. It is applicant's understanding that the Brick Institute of America defines a "cavity wall" as having a space greater than about 2 inches but not more than 4 inches between the masonry wythes.

A crack in the wall can allow water to enter the cavity. Moisture can condense on the inside of the wall under changing temperatures. Either way, water may collect in the cavity between the inner and outer wall.

The presence of moisture in the space between the inner wall and outer wall is undesirable for a number of reasons. First, the trapped moisture can degrade the inner and outer wall, causing a weakening of the structure. Second, the presence of water under freezing temperatures may also cause cracks in the walls when the water expands as it freezes. Trapped water in the cavity between the inner and outer walls may cause the walls to become discolored, and may even lead into the dwelling.

To overcome the problems associated with water trapped within a masonry cavity wall, weep holes are commonly placed along the base of the outer wall. The weep holes allow water to pass from the cavity to drain outside the wall structure. A flashing disposed in the cavity directs the collected water toward the weep holes.

During construction of a masonry cavity wall, excess mortar and other debris can and does fall between the inner and outer wall. When the bricks are stacked during the erection of the outer wall, for example, mortar droppings are squeezed into the space between the walls. The excess mortar, as well as other debris, drops to the base of the cavity, and can block the weep holes.

Wicks have been used in weep holes. For instance, a cotton wick, such as a segment of cotton rope, has been used in weep holes. Such wicks can be extended from the weep hole up within the cavity to a height considered sufficient to exceed any build-up of mortar droppings. Moisture within the cavity is absorbed by the wick, and passed to the outside face of the wall. Wicks are preferably made from cotton, because nylon or hemp are considered less efficient in transferring water. The cotton wick, however, may become broken or squashed, and will rot with time.

Accordingly, the weep hole may still become blocked during and after construction, thereby preventing moisture in the cavity from passing to the outside of the wall.

Another attempt to overcome the problems associated with obstructed weep holes is described in U.S. Pat. No. 4,852,320. The '320 patent describes embodiments of a mortar collection device located in the wall cavity. One embodiment is adapted to collect mortar but deflect water. This mortar collection device has an upper surface with sufficient inclination to cause moisture to slide off, but is purportedly insufficiently inclined to prevent mortar from falling off. A second embodiment has a plurality of vertically aligned passageways of dimension sufficient to allow moisture to pass therethrough but of insufficient dimension to allow mortar to pass therethrough. This honeycomb-like mortar collection device of the '320 patent is made from a non-water absorbent material, such as plastic.

It can be seen, nonetheless, that mortar or other debris may still roll down the surface of one or more of the collection devices of the '320 patent and plug a weep hole. Also, the '320 patent mortar collection devices are specially adapted to be carried on reinforcement rods extending between the inner and outer wall. they are not shown adapted to simply rest on the base of the all, so as to completely cover the weep holes. Furthermore, in the second embodiment of the '320 patent described above having the vertical passageways, small pieces of mortar or other debris may still pass through the holes extending through the unit, thereby allowing the debris to reach the base of the wall and plug the weep holes.

It would be desirable to have a combination flashing and mortar and debris collection device capable of resting on the base of the wall in the space between the inner and outer walls to direct water to and cover and protect the weep holes.

SUMMARY OF THE INVENTION

Accordingly, it is a principal objective of this invention to provide a combination flashing and mortar and debris collection device that can rest on the base of the wall cavity to direct water to the weep holes and to prevent mortar or debris of any significant size from reaching a weep hole and thereby blocking the holes.

Another objective is to provide a surface configuration for such a combination flashing and collection device which facilitates adequate dispersal of debris thereon to assure a water path remains to the device.

To the foregoing and other ends, the improved combination flashing and mortar and debris collection device of this invention comprises a flashing member having a mortar and debris collection material applied to at least a portion of the surface thereof. The flashing member preferably includes an upper portion that is received within the inner wall at an elevation above the floor of the cavity, an inclined central portion that extends from an elevated portion of the inner wall through the cavity to the base portion of the outer wall, and a lower portion that is received at the base of the outer wall. A mortar and debris collection material is provided along at least a portion of the outer surface of the central portion of the flashing member that permits water to pass therethrough and substantially prevents mortar and other debris from passing therethrough.

The mortar and debris collection material may comprise a non-absorbent water-permeable fibrous mesh material formed with circuitous (non-linear) pathways therethrough, which material can be readily attached to the flashing member. The fibrous material preferably has a porosity sufficient to permit water to pass therethrough, but insufficient to permit mortar or other debris of appreciable size to pass therethrough.

In accordance with another aspect of the invention, the lower portion of the flashing member may be provided with structural strips to serve as weep holes within the mortar joint at the base of the outer wall. These strips may comprise fibrous mesh material or preformed tubes or channels. In so doing, the combined flashing and mortar and debris collection systems of the present invention provide a single sheet-like product which serves the flashing function, the mortar and debris collection function, and the drainage function.

The objectives and advantages of the invention will be further understood with reference to the following detailed description of embodiments of the invention read in light of the accompanying drawings in which:

DETAILED DESCRIPTION OF EMBODIMENTS OF THE INVENTION

Figure 1:
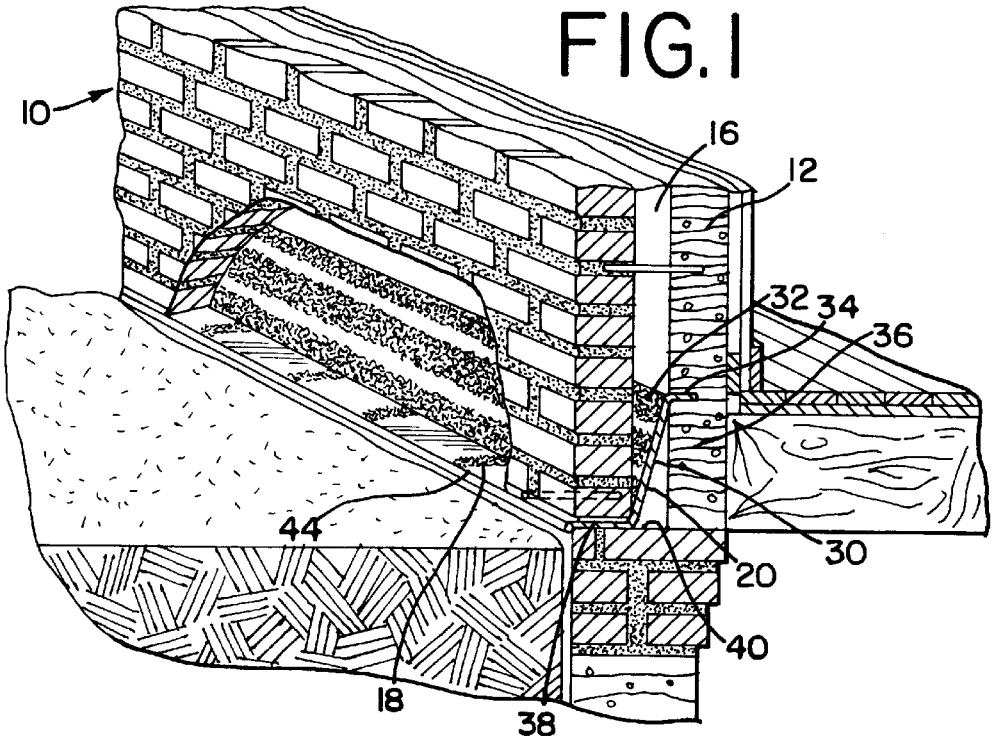
FIG. 1 is a perspective view, partially in section and partially broken away of a first embodiment of a combination flashing and collection device made according to the present invention located in a cavity between an inner and an outer wall.

Brick masonry cavity walls 10, as shown in FIG. 1 consists of two wythes of masonry separated by an air space. The interior masonry wythe (the inner wall) 12 may be brick, hollow brick, structural clay tile, wood or hollow or solid concrete masonry units, for example. The exterior masonry wythe 14 (the outer wall) is brick. The cavity 16 between the two wythes may be either insulated or left open as air space. The cavity has a typical width of about 2 to 4½ inches, but could be smaller, although non-standard.

A common problem associated with a cavity wall construction is how to allow moisture, as from seepage or condensation, to pass from the cavity to outside the wall. Weep holes 18 creating a passageway from the cavity to the outside of the wall are provided to this end. Generally, the weep holes 18 will be placed approximately 16 to 24 inches apart at the base of the outer wall 14. Moisture collecting in the cavity is intended to run down the cavity wall and be directed by the combination flashing and mortar and debris collection device 20 of the present invention toward the weep holes 18.

In the course of construction of a cavity wall 10 as shown in FIG. 1, mortar and other debris will commonly fall into the cavity 16 between the inner wall 12 and outer wall 14. The falling mortar is collected on the surface of the combination flashing and mortar and debris collection device 20 of the present invention.

Figure 2:
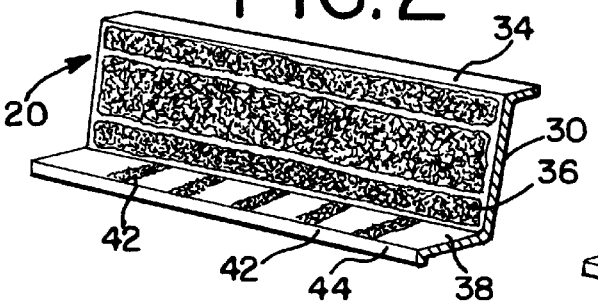
FIG. 2 is a perspective view of the first embodiment of the inventive combination flashing and collection device.

FIG. 2 shows one embodiment of a combination flashing and debris collection device 20 of the present invention. Device 20 comprises a flashing member 30 having a mortar and debris collection material 32 applied to at least a portion of the surface thereof. Flashing member 30 includes an upper portion 34, an inclined central portion 36 and a lower portion 38. Referring to FIG. 1, the upper portion 34 is preferably received within the inner wall 12 at an elevation above the floor 40 of the cavity 16. The central portion 36 is inclined and extends from the elevated portion of the inner wall 12 through the cavity 16 to a base portion of the outer wall at the floor 40. The lower portion 38 is preferably received at the base of the outer wall 18. The flashing member 30 functions to direct moisture collected in the cavity toward weep holes that are formed at the base of the outer wall 18 in a manner which will hereinbelow be further discussed. The flashing member may be made from various materials such as sheet metals, bituminous membranes, plastics, vinyls or the like.

A mortar and debris collection material 32 is suitably positioned along at least a portion of the outer surface of the central portion 36 of the flashing member 30. The material 32 functions to permit water to pass therethrough and to substantially prevent mortar and other debris from passing therethrough. The material is preferably a non-absorbent, water-permeable, fibrous mesh material formed with circuitous (non-linear) pathways therethrough. The material is preferably a mass of random filament-type plastic fibers with a density which is sufficient to catch and support mortar and other debris thereon without significant collapse, but allow water to pass freely therethrough. The overall thickness of the material 32 is preferably between one-eighth inch and one-half inch. A preferred embodiment of the material is a polyethylene or polyester fibrous mesh such as ENKADRAIN 9120 manufactured by Akzo Industries in Asheville, N.C. or FIBERBOND EM 6645 manufactured by Fiberbond in Michigan City, Ind. The material 32 may be of two or more different materials or layers. As seen in FIG. 2, the material 32 is attached to the flashing member in multiple spaced apart longitudinal strips.

Referring to FIG. 2, in accordance with a first embodiment of the invention, the lower portion 38 of the flashing member 30 may be provided with spaced apart strips 42 of the above described mesh materials, which serve to create the weep holes 18 within the mortar joint. The strips 42 may be provided with suitable reinforcement such as solid plastic rods or the like to accommodate the load of the bricks. The outer edge of the lower portion 38 may be provided with an overhang or lip 44. The lip 44 may be a colored strip to make the device invisible on the face of the building.

Figure 3:
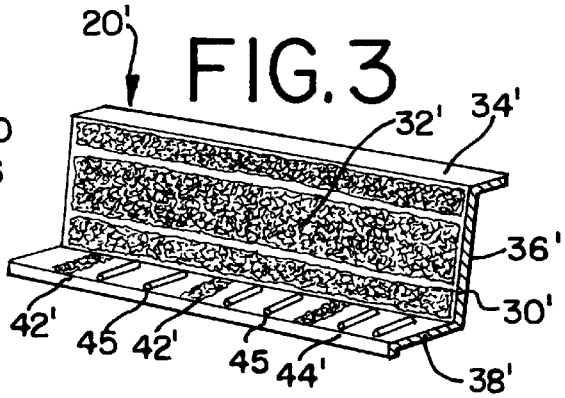
FIG. 3 is a perspective view of another embodiment of the inventive combination flashing and collection device.

Referring to FIG. 3, there is shown another embodiment of the invention wherein the same referenced numerals from the first embodiment followed by a prime sign are used to identify common elements. Device 20' includes a plurality of spaced apart structural bars or dowels 45 positioned between the strips 42'. The bar or dowels 45 serve as further reinforcement to accommodate the load of the bricks.

Figure 4:
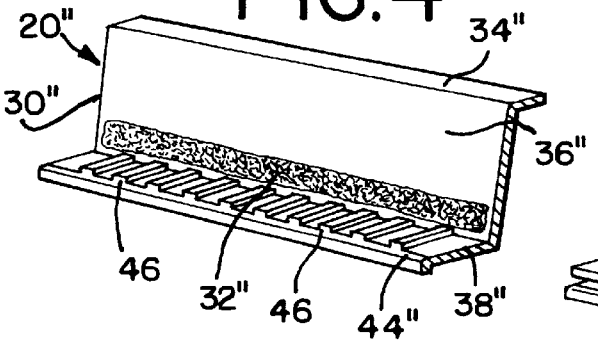
FIG. 4 is a perspective view of yet another embodiment of the inventive combination flashing and collection device.

Referring to FIG. 4 there is shown yet another embodiment of the invention wherein the same reference numerals from the first embodiment followed by a double prime sign are used to identify common elements. Device 20" includes a strip of material 32" adjacent the intersection of the central portion 36" and the lower portion 38". A plurality of spaced apart tubes or channels 46 are formed in the upper surface of lower portion 38" to create the weep holes within the mortar joint. The tubes or channels 46 alternatively may be integrally formed as a separate member or members positioned immediately adjacent the upper surface of portion 38". The tubes or channels 46 may be positioned over mesh strips 42 as shown in FIG. 2.

Figure 5:
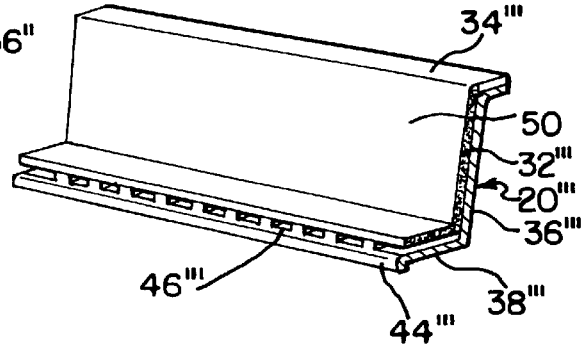
FIG. 5 is a perspective view of a still another embodiment of the inventive combination flashing and collection device.

Referring to FIG. 5, there is shown still another embodiment of the invention wherein the same reference numerals from the first embodiment followed by a triple prime sign are used to identify common elements. Device 20'" may take the form of the embodiments shown in FIGS. 2, 3 and 4 with the addition of a fabric material 50 positioned on top of the mesh material 32'" to assist in keeping mortar and debris from blocking the passage of water therethrough.

The present invention provides a single sheet-like product which serves as a flashing and a continuous drainage system that will allow water to have an exit along substantially the entire length of the product. In so doing, the possibility of ponding will be eliminated and ventilation of the cavity will be increased. The installation of the combination flashing and mortar and debris collection devices and systems of the present invention requires no adhesives or attachments other than that normally associated with current flashing installation.

While the combination flashing and mortar and debris collection devices and systems of the invention have been described with respect to a number of different embodiments, those skilled in the art will recognize changes and modifications in material, structure and form and the like which will still fall within the scope of the claims of this invention.

What is claimed is:

1. A cavity wall construction comprising:

(a) a first formed interior wythe defining an inner wall, (b) an exterior wythe defining an outer wall formed in place adjacent to and spaced apart from said inner wall and constructed from vertical stacks of bricks and mortar, (c) a cavity defined by the space between said inner wall, said outer wall and a floor, (d) a plurality of spaced apart channel openings formed at a base of said outer wall through which channel openings water can drain from said cavity to the exterior of said outer wall, (e) a combination flashing and mortar and debris collection device, comprising:

(1) a flashing member having an inclined portion that at least extends from an elevated portion of said inner wall through said cavity spaced from said floor to said outer wall adjacent a lower end thereof; and (2) a water-permeable material attached adjacent at least a portion of an outer surface of said inclined portion of said flashing member, said water-permeable material having a porosity sufficient to permit water to pass therethrough but substantially insufficient to permit mortar and debris to pass therethrough so that water passing therethrough drains through said weep holes and mortar and debris does not block said weep holes.

2. The invention as defined in claim 1 wherein said water-permeable material is a non-water absorbent randomly oriented fibrous material.

3. The invention as defined in claim 1 wherein said flashing member includes a central portion that extends from said elevated portion of said inner wall through said cavity to said outer wall and a lower portion that is received under said lower end of said outer wall; said water permeable material being positioned adjacent at least a portion of said central portion of said flashing member.

4. The invention as defined in claim 3 wherein said lower portion of said flashing member includes spaced apart strips of water-permeable material extending below said outer wall so as to define said weep holes.

5. The invention as defined in claim 4 wherein said lower portion of said flashing member includes spaced apart channels that receive said strips of water-permeable material.

6. The invention as defined in claim 4 wherein a plurality of spaced apart structural members are positioned above said lower portion of said flashing member.

7. The invention as defined in claim 3 wherein said lower portion of said flashing member includes spaced apart channels formed therein so as to define said weep holes.

8. The invention as defined in claim 3 wherein said lower portion of said flashing member is provided with a lip portion at an outer edge thereof.

9. The invention as defined in claim 3 wherein said flashing member includes an upper portion that is received in said elevated portion of said inner wall.

10. The invention as defined in claim 1 wherein a fabric material is provided at the outer surface of said water-permeable material.

11. The invention as defined in claim 1 wherein said water-permeable material is provided in a plurality of horizontally spaced apart strips.

12. The invention as defined in claim 1 wherein said water-permeable material is formed from different materials.

13. The invention as defined in claim 1 wherein the thickness of said water-permeable material is from about one-eighth inch to about one-half inch.

* * * * *